US006085821A

United States Patent [19]

Roberts

[11] Patent Number: 6,085,821

[45] Date of Patent: Jul. 11, 2000

[54] VALANCE BOARD

[76] Inventor: Beverly R. Roberts, 395 Castleridge Dr. NE., Atlanta, Ga. 30342

[21] Appl. No.: 09/257,334

[22] Filed: Feb. 25, 1999

[51] Int. Cl.[7] ..... A47H 1/00

[52] U.S. Cl. ..... 160/38

[58] Field of Search ..... 160/38, 39, 19, 160/330, 348, 327, 368.1, 404, 383, 384, 398

[56] References Cited

U.S. PATENT DOCUMENTS

| | | | |
|---|---|---|---|
| 2,430,959 | 11/1947 | Soff | 160/330 X |
| 2,570,731 | 10/1951 | Susnow | 160/19 X |
| 3,064,724 | 11/1962 | Nowell | 160/330 |
| 3,159,206 | 12/1964 | Susnow | 160/330 |
| 4,228,980 | 10/1980 | Beauchamp et al. | 160/330 X |
| 4,903,394 | 2/1990 | Roberts | 29/458 |
| 4,976,374 | 12/1990 | Macaluso | 220/453 |
| 5,042,549 | 8/1991 | Roberts | 160/39 |
| 5,067,542 | 11/1991 | Easley | 160/330 X |
| 5,361,821 | 11/1994 | Barone | 160/39 |

*Primary Examiner*—David M. Purol
*Attorney, Agent, or Firm*—Thomas, Kayden, Horstemeyer & Risley, L.L.P.

[57] ABSTRACT

A valance board assembly has a channel member of a stiff, hard, material such as, for example, a compressed laminate. The channel member is formed on an open-ended channel and contains a board of a lightweight material susceptible to receiving and holding pins affixed therein, and which is coextensive with, and substantially completely fills, the channel member. At least two plastic bracket members are configured to hold the channel member resting thereon, and stop members prevent it from sliding off. Decorative fabric may be affixed by pins to the lightweight material and draped to provide a decorative window effect.

17 Claims, 7 Drawing Sheets

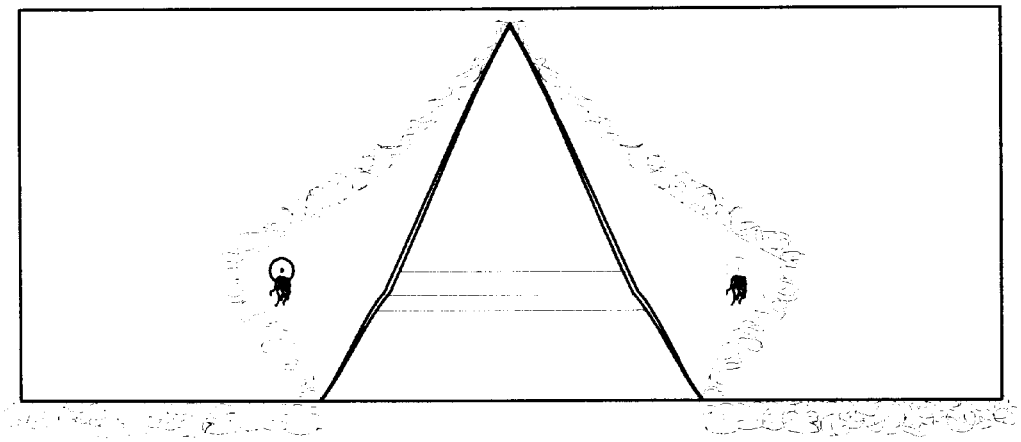
FIG. 6d VIII
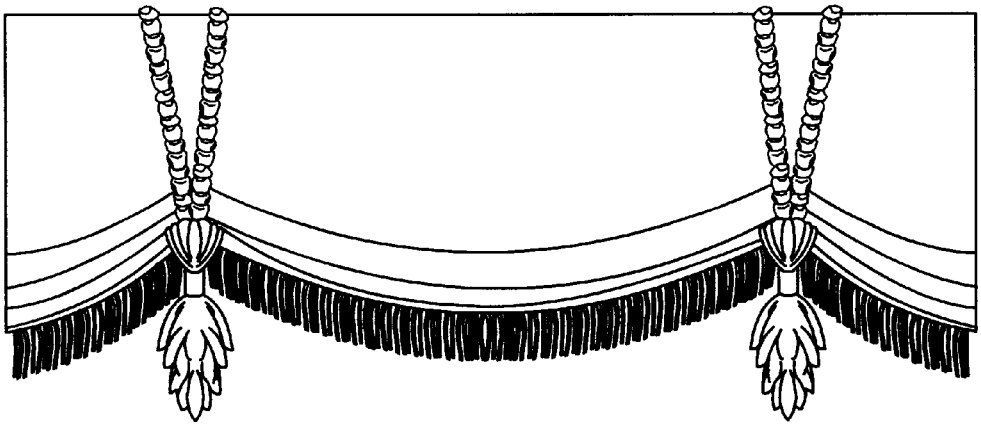
FIG. 6e IX
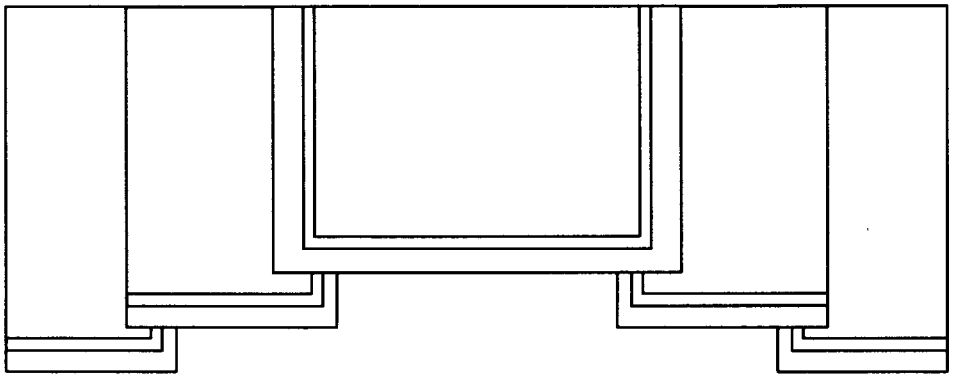
FIG. 6f X

VALANCE BOARD

FIELD OF THE INVENTION

This invention relates to decorative window top treatments, and more particularly, to a valance board arrangement for use over windows.

BACKGROUND OF THE INVENTION

There are, in use today, numerous types of window top treatments, characterized as either "hard" or "soft". Examples of the "hard" or structured treatments are the cornice board, lambrequin, and the cantoniere. Each of these treatments uses a unit which is made of rigid material and which has front, top, and side members of varying lengths, to which decorative fabric or material is attached which follows the shape and form of the unit. The "soft" treatment is exemplified by the valance, which is the most often used due to its simplicity, variety, economy, and versatility.

In general, a valance is a decorative fabric arrangement used as a top treatment over windows. It can be made in a variety of fabrics and styles, with the fabric itself hanging from a horizontal support unit positioned above the window. Other than the attachment of the fabric to the support unit, there is no additional fabric supporting hardware and thus the fabric has an unrestricted freedom to give a soft, draping, unstructured appearance.

The support unit may have any of a number of forms, such as rods, rings, hoops, swag holders and the like, none of which, however, allows creation of the "Georgian" style of drape which is, by far, the preferred treatment although there are numerous other styles New or contemporary or casual styles may also be desired. The Georgian style is most easily achievable where the support unit is a single rigid horizontal mounting board to which the fabric is attached. Because of its simplicity, such a mounting board has generally been made of a single piece of plywood or other suitable wood, such as, for example, pine. However, the use of wood presents numerous problems. The piece of wood, or plywood, must be sufficiently thick to withstand bending under the load of heavy hanging fabric, which results in an unduly heavy board that, in turn, requires heavy mounting brackets. In addition, even with sufficient thickness, the wood board is still subject to warpage. Wood is also permeable to moisture, which leads to warpage, generally has a distinctive odor, and is attractive to insects. Additionally, in a valance type arrangement, the bottom surface of the wooden board and especially the grain thereof is visible from below, thus, detracting from the overall appearance.

Usually valances are custom ordered from, for example, a drapery workroom. The workroom generally uses a plywood or pine board and covers it with white lining fabric, attached by the staple gun, for example. The white lining covers the underside of the board so that the wood is not visible. The decorative fabric is then cut and sewn to the desired pattern and attached to the top of the mounting board by staples, tacks, brads, nails, or other suitable means. L-shaped brackets of metal or other suitable material are either joined to the board as by screws, or are supplied with the finished valance for the installer to mount on the wall above the window and then to join the board thereto.

When such a valance is custom made, it is sometimes several weeks between order and delivery, and the completed valances can be quite expensive. As a consequence, it has become common for the homeowner or other user to assemble the valance on a "do-it-yourself" basis. The steps involved in producing a valance on such a basis are substantially the same as those performed by the drapery workshop, except that the individual must gather all of the components on his or her own prior to assembling and installing the valance. Not only is such a procedure tedious and time consuming, but cutting and sewing the fabric by someone less than an expert can produce catastrophic results.

For example, a board having the requisite stiffness and resistance to warpage must be cut to the desired size, such as, for example, from thirty-eight inches (38") to forty-two inches (45") in length. The board must then, in order to hide the wood surfaces, either be painted or covered with white lining fabric, preferably tacked or stapled in place. Mounting brackets must then be attached to the board. The brackets must be configured such that they can be attached to the board without interfering with, or obtruding onto those surfaces of the board to which the decorative fabric is to be attached.

The decorative fabric may then be mounted to the board and then brackets affixed to the wall containing the window, or, in some cases, to the window molding. Alternatively, the board and brackets may be mounted and then the decorative material applied. In either case, the process of placing and affixing the board is awkward and made even more difficult because of the weight of the board and bracket assembly.

SUMMARY OF THE INVENTION

The present invention overcomes the aforementioned problems of the prior art in that it is quite light, is designed to rest on specially designed brackets but unaffixed thereto, and can be quickly and easily removed for replacement or redecoration with, for example, a different decorative fabric or fabrics. It also makes creation of a large number of styles, both traditional and contemporary, easily accomplished by the user.

In a preferred embodiment of the invention, an elongated open ended channel member contains, in its channel, a dense expanded polystyrene board which is preferably glued to the wall or walls and floor of the channel, or otherwise attached thereto as by screws or bolts. Gluing is to be preferred inasmuch as there is no affixing means that might be visible after the valance is in place. The channel member which is extremely stiff, is preferably made of several layers of cardboard or laminated paperboard compressed into the desired form or shape. For appearance sake, at least the outer layer, i.e., most visible, of cardboard has a hard glossy white "clay" or other color finish, although a matte white or other color finish can be used. Such material is virtually immune to moisture, warpage and insects, is light weight yet stiff and strong, and has little or no odor. A stiff, hard plastic material might also be used to form the channel member.

The channel member has a channel having a floor and upstanding side walls into which is placed and contained a board of expanded polystyrene which fills the channel preferably up to the top edges of the side walls. As pointed out hereinbefore, the polystyrene board is preferably glued in place within the channel, although other affixing means might be used. The assembly forms a valance board that is stiff, strong, extremely light weight, and immune to warpage and the depredations of insects. The material of the channel member itself is commercially available item, as is, of course, the expanded polystyrene. Other materials possessing the requisite characteristics, such as cork as a substitute for the polystyrene might be used. Such materials are generally too expensive or not as amenable to cutting and sizing as expanded polystyrene.

The valance board of the invention is mounted on at least two brackets of suitable material, such as an acrylic. Each bracket is substantially L-shaped and has a down arm with screw holes therein for mounting to the wall, preferably just above the window frame, where they remain in place. Each bracket has a horizontal arm extending from the top of the down arm which has a length slightly greater than the width of the channel member, e.g., four and one-eight inches (4⅛") for a four inch (4") wide channel member. Each horizontal arm, at its distal end, has a stop member such as a vertically upstanding leg of approximately one inch (1") in length. When the brackets are in place, the channel member is mounted thereto simply by being placed on the top surfaces of the bracket horizontal arms, with the expanded polystyrene board facing up. When the decorative fabric is to be attached to the valance board, the board is simply lifted off the brackets and transported to a convenient work place. The decorative fabric is preferably affixed to the polystyrene board by means of pins, tacks, staples, clips, or the like, or can even be permanently affixed by gluing. It has been found that two-prong pins, which easily penetrate both fabric and polystyrene, are the easiest and most reliable means for attaching the fabric.

The numerous features and advantages of the present invention will be more readily apparent from the following detailed description, read in conjunction with the accompanying drawings.

DESCRIPTION OF THE DRAWINGS

FIGS. 6*a* through 6*i* are elevation views of still more decorative arrangements that utilize the valance board of the invention.

DETAILED DESCRIPTION

In FIGS. 1*a* through 1*d* there are shown several Georgia style decorative valances, the making of each of which is, as will be explained more fully hereinafter, greatly facilitated through use of the valance board of the present invention. It can be seen from these figures that a wide variety of decorative valances is possible, the examples shown in FIGS. 1*a* through 1*d* being for purposes of illustrating the versatility possible with the invention.

Figure 1A:
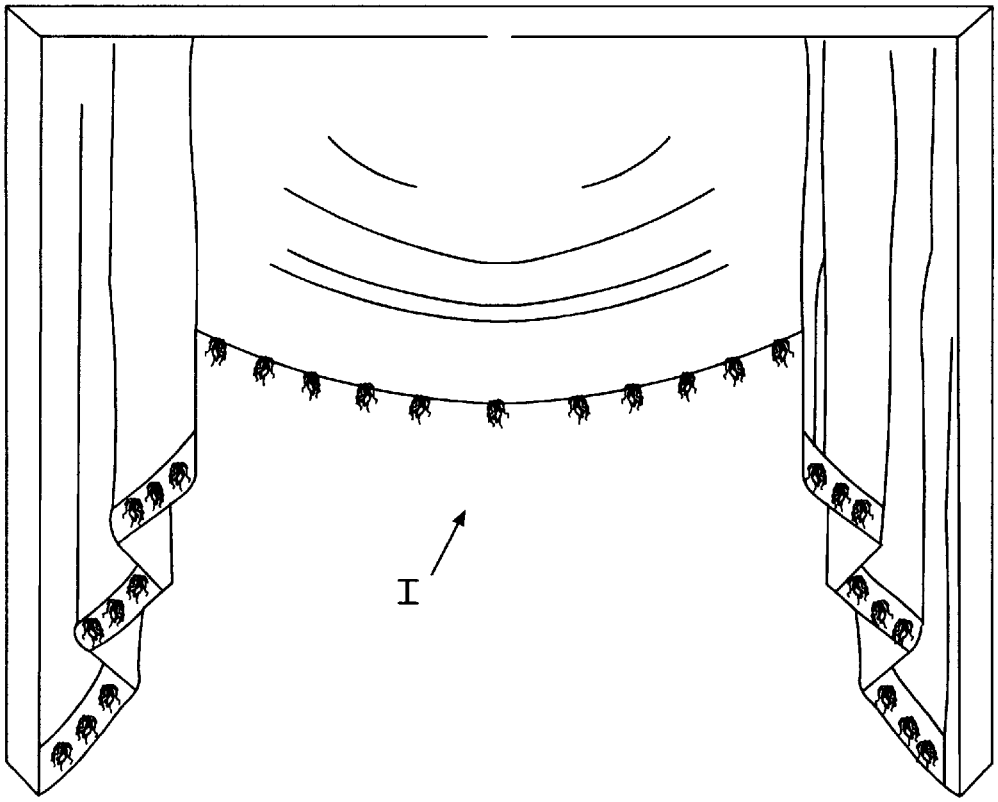
FIGS. 1*a* through 1*d* are elevation views of Georgian style four decorative valances utilizing the valance board of the invention.
Figure 1C:
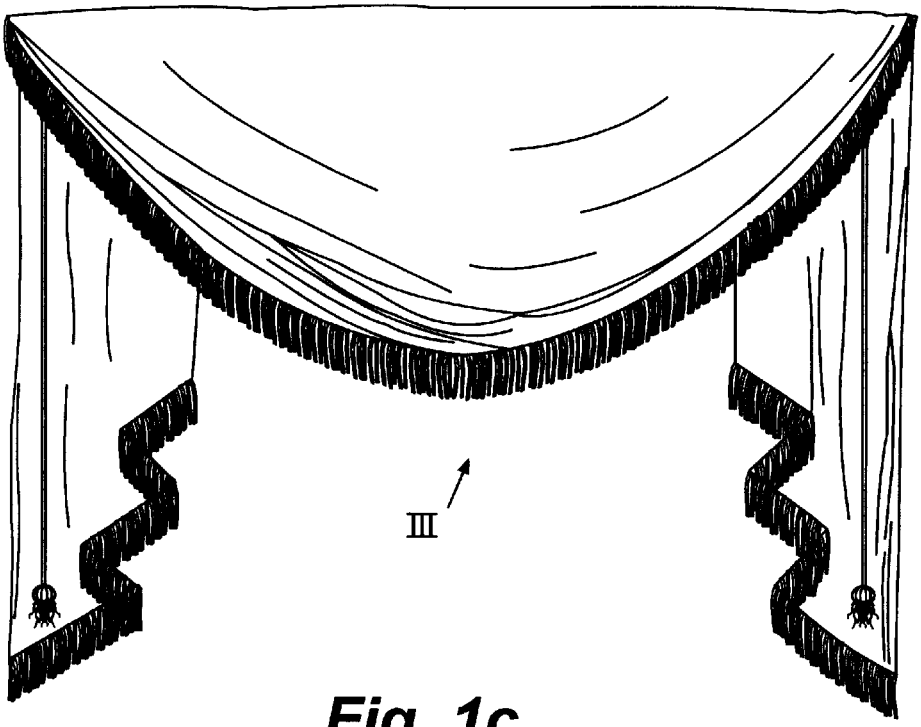
Figure 1B:
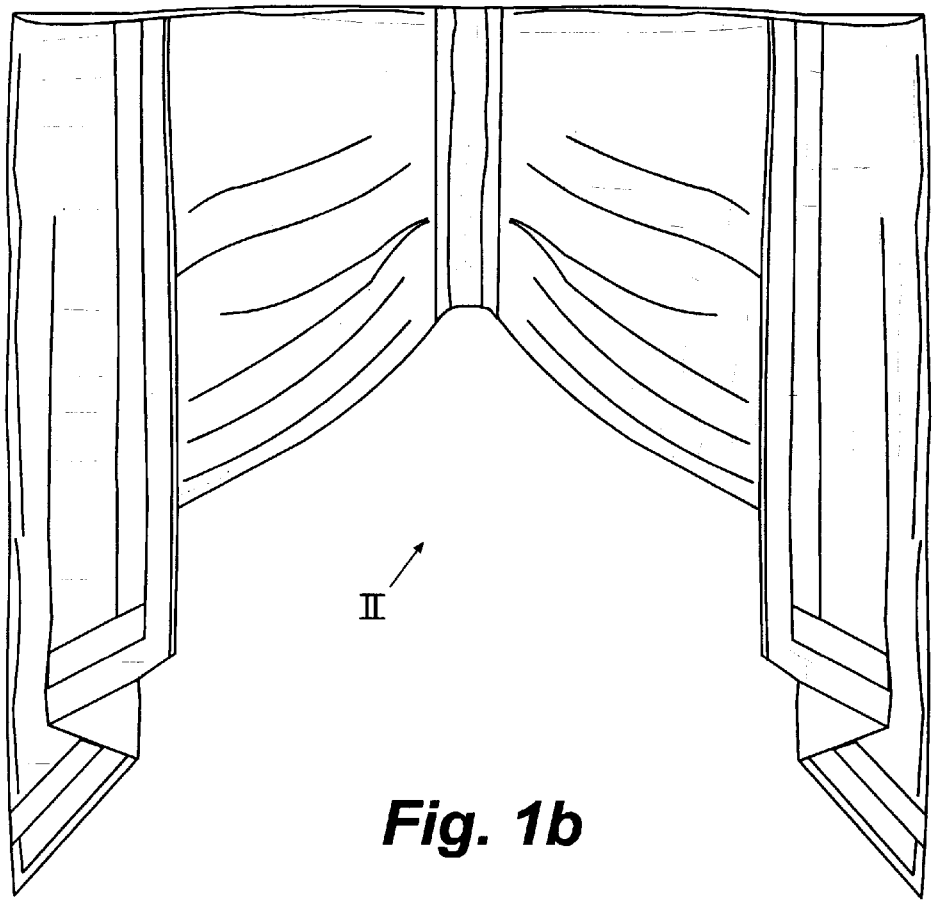
Figure 1D:
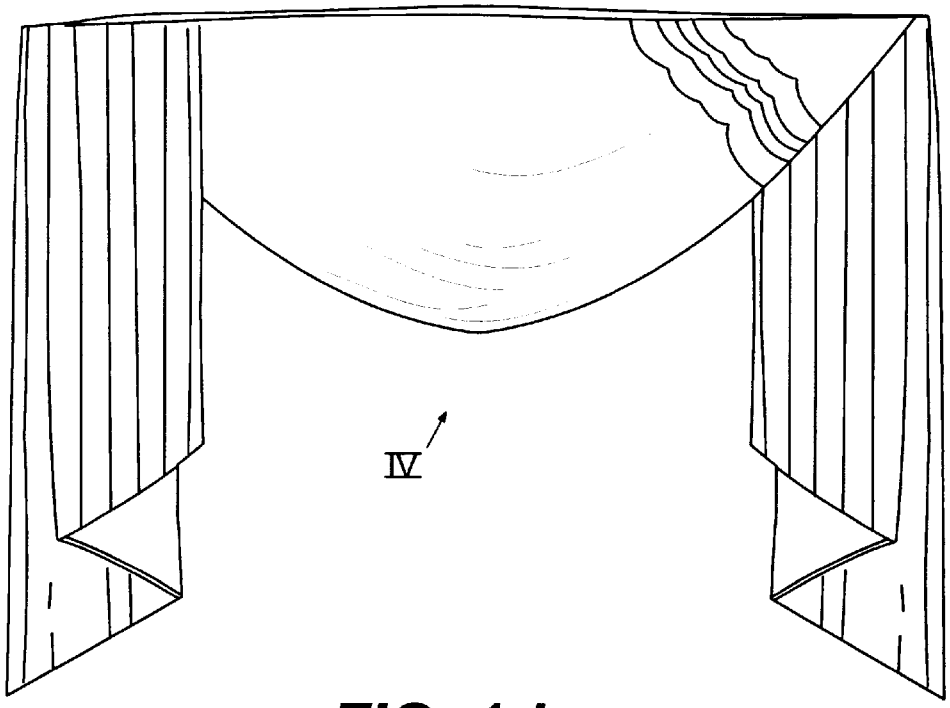
Figure 2:
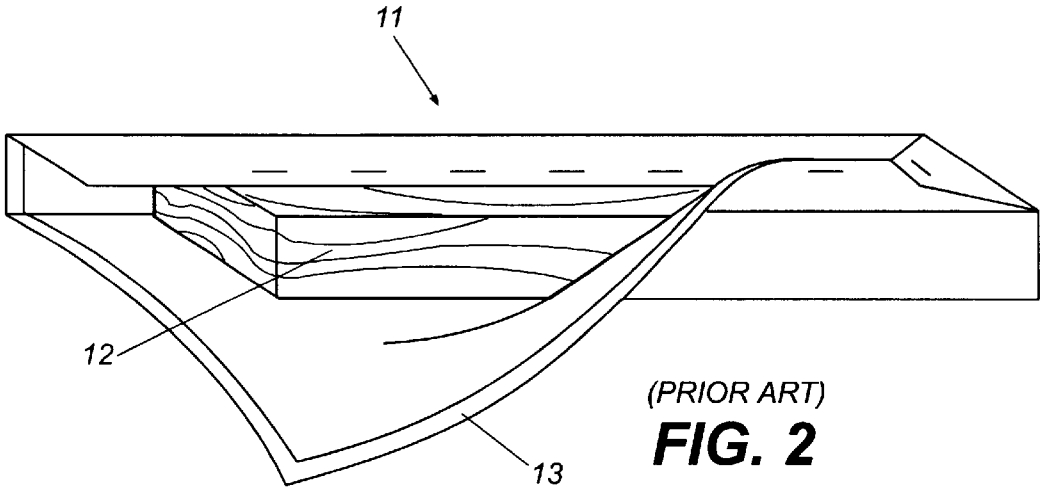
(PRIOR ART) FIG. 2
FIG. 2 is a perspective view of a prior art valance board arrangement.

FIG. 2 is a view of a prior art valance board arrangement 11 which can be used in making the valances illustrated in FIGS. 1*a* through 1*d*. However, inasmuch as the valance board of FIG. 2 is made of a slab 12 of wood which may be a 1"×4" board, it must first be covered with white lining fabric 13, as shown in FIG. 2. Without such covering, the rough finish of the raw wood can cause snagging, wear, or even tearing of the fabric. As pointed out hereinbefore, wood, although commonly used as a valance board in the prior art, is heavy, especially since it must be thick enough to withstanding bending forces under the heavy load of hanging fabric, which, itself, can be quite heavy. Additionally, it is subject to warpage, permeable to moisture, which induces warpage, unsightly unless covered by lining fabric, subject to depredation by insects, and generally has a distinctive odor. Such light woods as balsa are subject to most, if not all, of the foregoing drawbacks except, perhaps, weight, and generally have the added disadvantage of structural weakness and cost, since most such woods are expensive. Plywood, at least to some extend, can eliminate the warpage and bending, but is, itself, both heavy and expensive, as well as being somewhat difficult to cut or machine smoothly.

Figure 3:
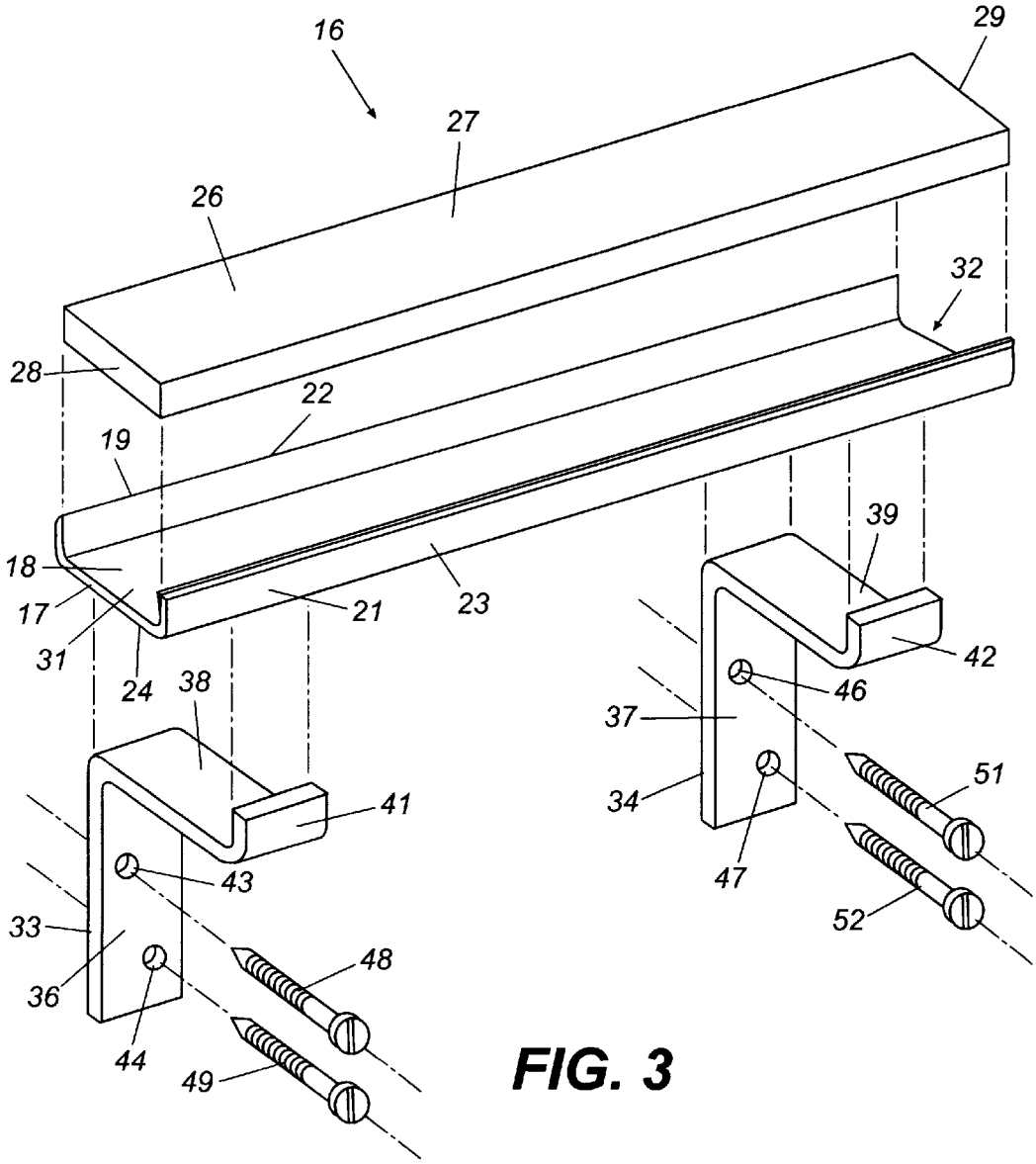
FIG. 3 is an exploded perspective view of the valance board assembly of the present invention.

In FIG. 3 there is shown, in an exploded perspective view, the valance board assembly 16 of the present invention. Board assembly 16 comprises an elongated channel member 17 which is preferably made of laminated paperboard or layered cardboard compressed into the desired channel shape, and includes a floor 18 and upstanding vertical sides 19 and 21. It is to be understood that the channel member 17 may be made, for example, of a rigid plastic molded to the desired shape. Whether laminated or a plastic, however, the outer surfaces 22, 23, and 24 preferably have a glossy or matte finish, preferably white in color, although other colors might be used for particular decorative effects. It is most desirable that those surfaces which might be visible be so finished. Thus, it may be necessary to have only the outer surface 24 so finished. The channel member 17 is open at both ends and is adapted to receive an elongated board or member 26 of, for example, expanded polystyrene which is light in weight, stiff, and permeable to pins, tacks, staples, or the like, which may be inserted therein, as will be discussed more fully hereinafter. Board 26 is dimensioned to fit into the channel of member 17 and is of a thickness to make its top surface substantially flush with the top edges of the upstanding sides 19 and 21, and of a length to make its ends 28 and 29 substantially flush with the open ends 31 and 32 of member 17. Board 26 is preferably affixed to channel member 17 by cement or glue, although other affixing means such as screws or fasteners might be used. It is desirable that, whatever fixing means is used, it not be readily visible or obtrusive.

Figure 4:
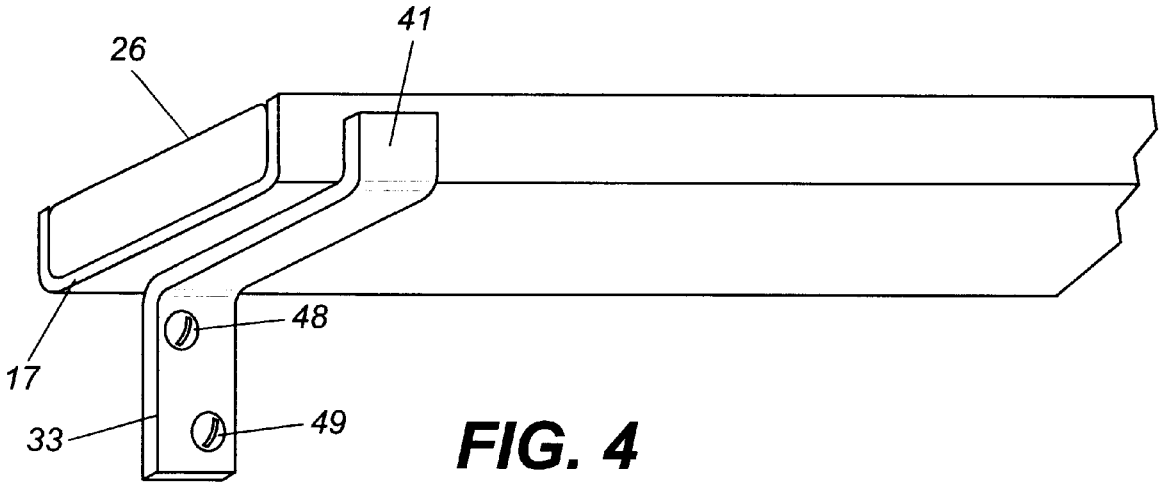
FIG. 4 is a partial perspective view of the valance board of the invention as assembled and mounted.

The channel member 17 and the polystyrene board 26, when thus assembled, form the valance board 16 of the invention. First and second brackets 33 and 34, as part of the total valance board assembly, form the support members for the valance board. Each bracket, which is preferably made of a plastic material such as, for example, a clear acrylic, comprises a vertical or down arm 36, 37, from the top end of which extends a horizontal arm 38, 39. The length of arm 38, 39 is slightly greater than the width of channel member 17, e.g., four and one-eighth inches (4⅛") for the arm and four inches (4") for the channel member 17. These dimensions may vary, for instance, where, for whatever reason, it is desired to have a wider or a narrower valance board. At the distal end of each of the arms 38, 39 is a stop member 41, 42 which comprises a vertically upstanding leg which may be, for example, one inch (1") in length. Each of the down arms 36, 37 has a pair of screw or bolt holes 43, 44 and 46, 47, preferably offset, as shown, for receiving mounting screws or bolts 48, 49 and 51, 52. The mounting screws shown, for mounting brackets 33 and 34 to the wall or to the window molding, are representative of any of a number of different types of mounting means, such as, for example, moly bolts, toggle bolts, anchored screws, suitable nails, or the like. FIG. 4 is a partial illustration of the valance board assembly 16 with the bracket 33, the channel member 17 and the polystyrene board 26 mounted in place, but without the decorative fabric.

Figure 5:
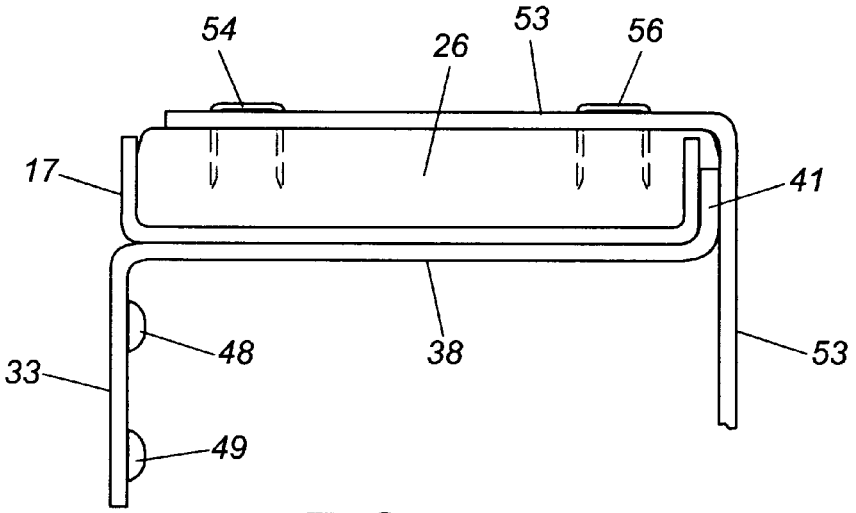
FIG. 5 is an end view of the assembled valance board of the invention with the decorative fabric in place.
Figure 6A:
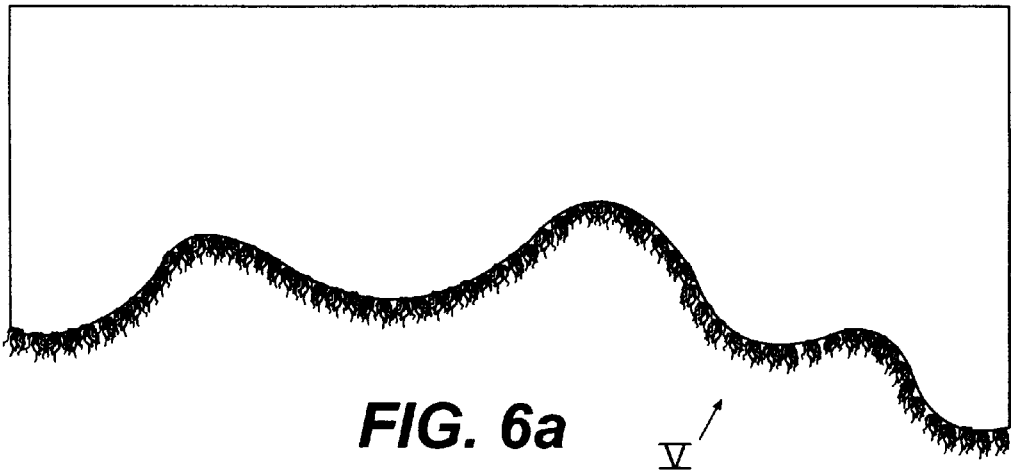
Figure 6B:
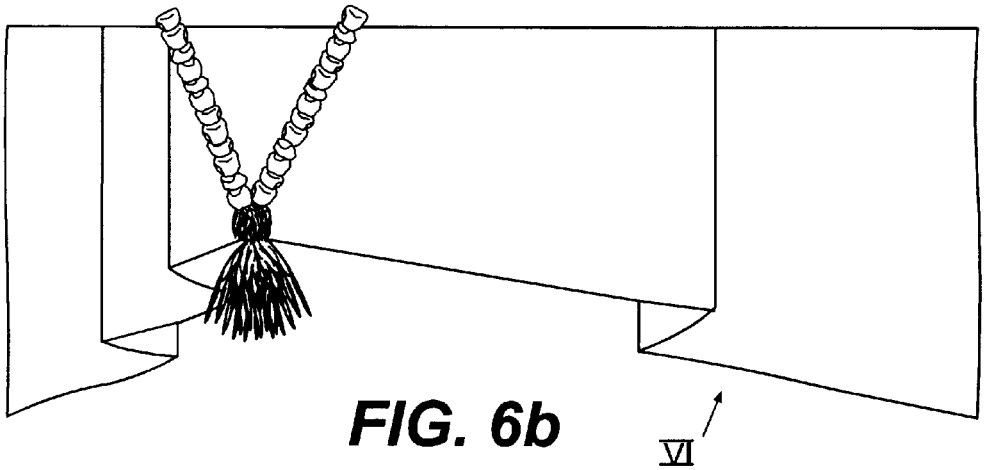
Figure 6C:
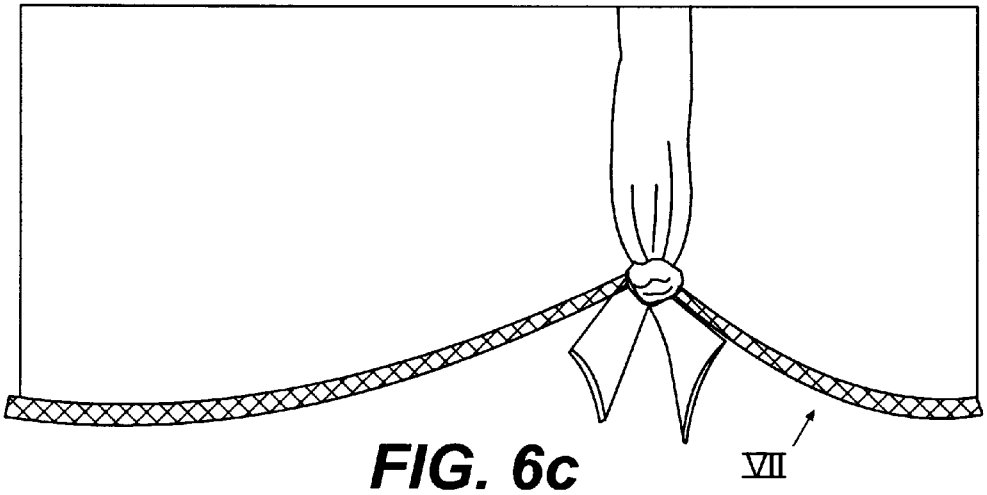
Figure 6G:
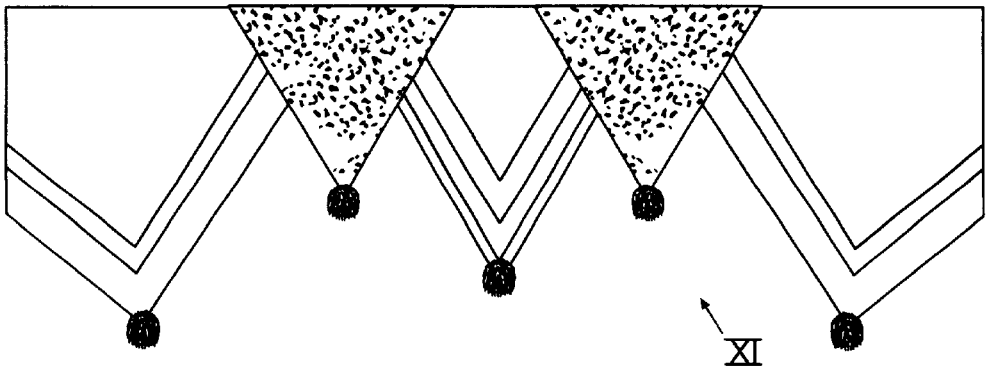
Figure 6H:
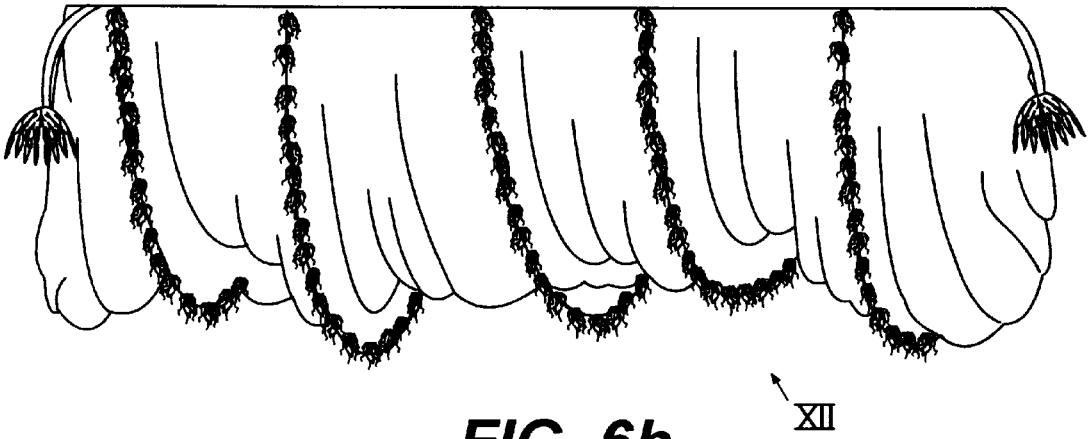
Figure 6I:
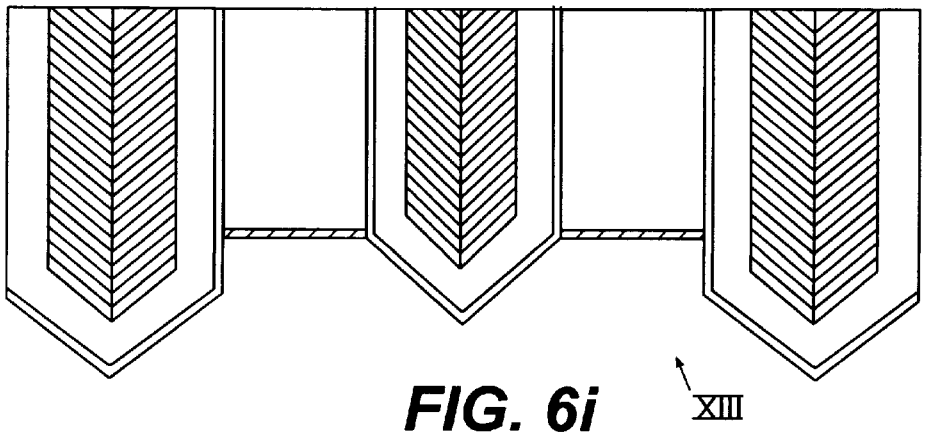

FIG. 5 is a cross-section of the valance board comprising channel member 17 and polystyrene board 26 with the decorative valance fabric 53 mounted and held in place by a plurality of two-prong trim pins 54 and 56. It has been found that trim pins, which easily penetrate the fabric and the polystyrene board 26, and which are commonly used in the art, work quite well in mounting fabric 53 to the valance board. Other fastening or affixing means, such as staples, tacks, or ordinary straight or dress pins, and the like can also be used; however, the trim pins 54 and 56 are light weight, strong, and unobtrusive. The ends of the channel member 17 and board 26 are preferably covered by means of envelope or hospital folds of the fabric, not shown, so that ends are preferably completely concealed. In FIG. 5 it can be seen that when the valance board (members 17 and 26) has been covered with the fabric 53, the board is laid in place upon the brackets 33 and 34, resting on arms 38 and 39, stop members 41 and 42 are behind, and covered by, the hanging portion of material 53, so that they, too, are concealed.

The structure of the valance board, the few parts required for assembly into its desired location, and the relative ease in application of the decorative fabric all serve to make the entire collections of components a commercially viable product in kit form. The consumer is not intimidated by the thought of having to locate the individual parts and assemble them prior to constructing the valance board. Trips to lumber and hardware stores are not necessary to find the proper wood (or other material), the properly sized and configured mounting brackets, and to purchase a staple gun. It is not necessary to locate a sufficient amount of white lining fabric, nor is it necessary to cut, or have cut, the board to proper size.

The kit form of the invention includes the channel member 17 and the polystyrene board 26 already joined together and cut to the proper length. Lengths, of course, will vary with the size of the window to be treated. In general, the board length should be approximately two inches greater than the window width. Thus, the kits would be available in several lengths of valance board, although instructions for cutting the board can be included.

The kit also includes two acrylic brackets with suitable mounting screws. As pointed out hereinbefore, moly bolts, toggle bolts, dry wall screws or the like can be used, hence, the kit may contain one particular type, or the several types. This could, of course, be noted on the exterior of the carton which contains the kit.

In addition to the foregoing, the kit may contain a plurality of no-sew patterns, full size, with complete instructions for use. A roll of iron-on bonding tape, such as, for example, fifteen (15) yards and twenty-four (24) to thirty (30) double prong trim pins are also included. Thus, the kit contains everything necessary except the decorative fabric. The consumer, using the desired pattern, cuts her fabric to shape and joins any seams with the iron-on tape. An ordinary hand (or desk) stapler can be used to hold folds or pleats in position. The bonding tape and/or fabric glue is used to apply any trim to be used. The prepared fabric is then placed upon the valance board of the invention with about two inches (2") of fabric folded thereon. (The patterns allow for these extra inches). The trim pins are then used to pin the fabric to the polystyrene board, thereby completing the decoration of the board. The board can then be lifted up to rest upon the brackets, as shown in FIG. 5. Sideways adjustments for centering are easily made, which is one of the advantages of the present invention. Because the board, with fabric attached, can be easily lifted off of the brackets, it makes possible the cleaning of the windows and surrounding frame or attached blinds without running the risk of spotting or staining the fabric. FIGS. 6*a* through 6*i* illustrate several additional decorative valance arrangements, designated V through XIII, possible through use of the valance board of the invention.

The valance board assembly as described hereinbefore, is an extremely stiff, strong, and lightweight board to which it is much easier to apply and affix decorative fabric than heretofore in the art. It should be noted that it will be obvious to those skilled in the art that many variations and modifications may be made to the preferred embodiment, as illustrated in the foregoing, without substantial departure from the principles of the present invention. All such variations and modifications are intended to be included herein as being within the scope of the present invention, as set forth in the claims. Further, in the claims hereinafter, the corresponding structures, materials, acts, and equivalents of all means or step plus function elements are intended to include any structure, material, or acts for performing the functions with other claimed elements as specifically claimed.

What is claimed is:

1. A valance board for use in mounting valances to windows and the like, said board comprising:

a stiff longitudinal channel member having a floor portion and first and second upstanding wall portions having top edges and defining the width of said floor portion, said channel member being of material forming a relatively hard surface and forming an open ended channel; and a board member of lightweight material susceptible to receiving and holding fabric fastener members, said board member dimensioned to fit within said channel member and being substantially coextensive therewith, said board member having a thickness extending from said floor portion to said top edges of said wall portions.

2. A valance board as claimed in claim 1 wherein said board member is made of a porous plastic material.

3. A valance board as claimed in claim 2 wherein said porous plastic material is expanded polystyrene, and further including means for affixing said board member to said channel member.

4. A valance board as claimed in claim 1 wherein said channel member is made of a compressed laminated material.

5. A valance board as claimed in claim 4 wherein said laminated material is laminated paperboard compressed into a channel shape.

6. A valance board is claimed in claim 4 wherein said laminated material is laminated cardboard compressed into a channel shape.

7. A valance board as claimed in claim 4 wherein said floor portion and said first and second upstanding wall portions have inner and outer surfaces, said wall portions being substantially equal to each other in height.

8. A valance board as claimed in claim 7 wherein at least one of said outer surfaces has a hard glossy finish.

9. A valance board as claimed in claim 8 wherein said glossy finish is white.

10. A valance board as claimed in claim 7 wherein at least one of said outer surfaces has a hard matte finish.

11. A valance board as claimed in claim 10 wherein said matte finish is white.

12. A valance board assembly for windows comprising:

a valance board, said valance board comprising a stiff channel member having an open ended channel therein;

a board member being sized and shaped to fit within said open ended channel and coextensive therewith;

bracket means for supporting said valance board, said bracket means comprising first and second substantially L-shaped members and including means for mounting said brackets adjacent the window, said bracket means having surfaces for supporting said valance board.

13. A valance board assembly as claimed in claim 12 wherein said substantially L-shaped members are made of acrylic material.

14. A valance board assembly as claimed in claim 12 wherein each of said substantially L-shaped brackets has a downwardly extending arm for mounting said bracket and a horizontal arm extending from the top of the downwardly extending arm, said horizontal arm having a distal end.

15. A valance board assembly as claimed in claim 14 wherein said distal end has a stop member comprising a vertically upstanding leg.

16. A valance board assembly as claimed in claim 12 wherein said board member is affixed to said channel member.

17. A valance board assembly as claimed in claim 12 wherein said board member is glued within said channel member.

* * * * *